US009449779B2

(12) United States Patent
Suzuki et al.

(10) Patent No.: US 9,449,779 B2
(45) Date of Patent: Sep. 20, 2016

(54) COOLING STRUCTURE FOR OPEN X-RAY SOURCE, AND OPEN X-RAY SOURCE

(75) Inventors: Naonobu Suzuki, Hamamatsu (JP); Kinji Takase, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 91 days.

(21) Appl. No.: 14/002,123

(22) PCT Filed: Mar. 1, 2012

(86) PCT No.: PCT/JP2012/055262

§ 371 (c)(1),
(2), (4) Date: Aug. 29, 2013

(87) PCT Pub. No.: WO2012/118155

PCT Pub. Date: Sep. 7, 2012

(65) Prior Publication Data

US 2013/0336462 A1 Dec. 19, 2013

(30) Foreign Application Priority Data

Mar. 2, 2011 (JP) ..... 2011-045469

(51) Int. Cl.

| | |
|---|---|
| ***H01J 35/02*** | (2006.01) |
| ***H01J 35/16*** | (2006.01) |
| ***H01J 35/14*** | (2006.01) |

(52) U.S. Cl.

CPC ..... *H01J 35/02* (2013.01); *H01J 35/14* (2013.01); *H01J 35/16* (2013.01); *H01J 2235/06* (2013.01); *H01J 2235/087* (2013.01); *H01J 2235/12* (2013.01)

(58) Field of Classification Search

CPC .... H01J 235/12; H01J 35/14; H01J 2235/06; H01J 2235/12; H01J 35/16

See application file for complete search history.

(56) References Cited

U.S. PATENT DOCUMENTS

| | | | | |
|---|---|---|---|---|
| 4,573,186 | A | 2/1986 | Reinhold | |
| 2006/0269048 | A1* | 11/2006 | Cain | 378/142 |
| 2008/0181365 | A1 | 7/2008 | Matoba | |
| 2009/0080617 | A1* | 3/2009 | Andrews | 378/142 |
| 2011/0038461 | A1 | 2/2011 | Andrews | |
| 2011/0038462 | A1* | 2/2011 | Davies et al. | 378/140 |

FOREIGN PATENT DOCUMENTS

| | | | |
|---|---|---|---|
| JP | 6-18119 | B2 | 1/1984 |
| JP | 7-82824 | B2 | 9/1995 |
| JP | 2004-510304 | A | 4/2004 |
| JP | 3950389 | B2 | 8/2007 |
| JP | 2009-193789 | A | 8/2009 |
| JP | 2009-301908 | | 12/2009 |
| JP | 2009-301911 | | 12/2009 |

* cited by examiner

*Primary Examiner* — David J Makiya
*Assistant Examiner* — Dani Fox
(74) *Attorney, Agent, or Firm* — Drinker Biddle & Reath LLP

(57) ABSTRACT

An aperture cooling structure (a cooling structure used for the open X-ray source) 10 comprises an aperture unit 31 formed with an aperture 33, a holder 34 for holding the aperture unit 31, and a heat dissipator 36 connected to the holder 34. The aperture 33 restricts an electron beam E from passing therethrough on an electron path 4 of an X-ray generator (open X-ray source). The heat dissipator 36 has a heat dissipation member 37 including a coolant flow path constituent part 41 and a heat dissipation member 38 including a coolant flow path constituent part 42. The coolant flow path constituent part 41 and the coolant flow path constituent part 42 are combined with each other, so as to construct a coolant flow path 43.

5 Claims, 8 Drawing Sheets

COOLING STRUCTURE FOR OPEN X-RAY SOURCE, AND OPEN X-RAY SOURCE

TECHNICAL FIELD

The present invention relates to a cooling structure for an open X-ray source and an open X-ray source.

BACKGROUND ART

Known as examples of conventional open X-ray sources are those described in Patent Literatures 1 to 3. Each of the open X-ray sources described in Patent Literatures 1 to 3 comprises an electron source for emitting an electron beam, a target for generating an X-ray in response to the electron beam incident thereon, an electron path, extending from the electron source to the target, for transmitting the electron beam therethrough, and an electromagnetic coil arranged so as to surround the electron path. These open X-ray sources can open and close the electron path with respect to external atmospheres and vacuum the electron path when closed.

The open X-ray sources described in Patent Literatures 1 to 3 use cooling structures for cooling their targets and electromagnetic coils with water. This inhibits the X-ray from shifting its focal point due to thermal expansions of members constituting the open X-ray sources at the time when they operate and thereby deteriorating characteristics.

CITATION LIST

Patent Literature

Patent Literature 1: Japanese Patent Publication No. 6-18119

Patent Literature 2: Japanese Patent Publication No. 7-82824

Patent Literature 3: Japanese Patent No. 3950389

SUMMARY OF INVENTION

Technical Problem

In the open X-ray sources described in Patent Literatures 1 to 3, however, the X-ray focal spot drift caused by thermal expansions of their constituent members may not be suppressed sufficiently in particular in X-ray tubes which are required to be used under microfocus conditions. The reason is as follows.

For achieving a microfocus, not only converging the electron beam but removing its scattered components is very important. Therefore, an aperture unit formed with an aperture is arranged on the electron path so as to remove the scattered components of the electron beam. In this case, the aperture unit may remove as much as 80% to 90% of the electron beam emitted from the electron source, for example. This generates a very large amount of heat in the aperture unit. Hence, cooling the target and electromagnetic coil alone may fail to fully suppress the X-ray focal spot drift caused by thermal expansions of constituent members.

It is therefore an object of the present invention to provide a cooling structure used for the open X-ray source which can effectively remove the heat generated from the aperture unit and securely suppress the X-ray focal spot drift caused by thermal expansions of constituent members due to the heating of the aperture unit in an open X-ray source, and an open X-ray source equipped with such a cooling structure.

Solution to Problem

For achieving the above-mentioned object, the cooling structure used for the open X-ray source in accordance with one aspect of the present invention is a cooling structure used for an open X-ray source comprising an electron source for emitting an electron beam, a target for generating an X-ray in response to the electron beam incident thereon, and an electron path, extending from the electron source to the target, for passing the electron beam therethrough, the open X-ray source being adapted to open and close the electron path with respect to an external atmosphere and vacuum the electron path when closed; the cooling structure comprising an aperture unit arranged on the electron path and formed with an aperture for restricting the electron beam from passing therethrough, a holder holding the aperture unit, and a heat dissipator connected to the holder; wherein the heat dissipator has a first heat dissipation member including a first coolant flow path constituent part and a second heat dissipation member including a second coolant flow path constituent part; and wherein the first coolant flow path constituent part and the second coolant flow path constituent part are combined with each other so as to construct a coolant flow path.

In this cooling structure used for the open X-ray source, the coolant flow path is formed in the heat dissipator, whereby the heat generated in the aperture unit propagates to the coolant in the coolant flow path through the holder and heat dissipator. Therefore, the cooling structure used for the open X-ray source can effectively remove the heat generated in the aperture unit and securely suppress the X-ray focal spot drift caused by thermal expansions of constituent members due to the heating of the aperture unit in the open X-ray source.

Here, the aperture unit may be made of a material having a melting point higher than that of the holder, while the holder may be made of a material having a coefficient of thermal conductivity higher than that of the aperture unit. This structure can stably restrict the electron beam from passing through the aperture unit. This also allows the heat generated in the aperture unit to propagate efficiently from the aperture unit to the holder, thereby more securely suppressing the X-ray focal spot drift caused by thermal expansions of constituent members due to the heating of the aperture unit.

The holder may have a flange surrounding the electron path and be in surface contact with the heat dissipator through the flange. This structure can increase the contact area between the holder and heat dissipator, so as to allow the heat generated in the aperture unit to propagate efficiently from the holder to the heat dissipator, thereby more securely suppressing the X-ray focal spot drift caused by thermal expansions of constituent members due to the heating of the aperture unit.

The first heat dissipation member and the second heat dissipation member may be made of the same material. This structure can inhibit the first and second coolant flow path constituent parts from generating a gap therebetween due to the difference between their coefficients of thermal conductivity, so as to securely prevent the coolant from leaking out of the coolant flow path, thereby stably removing the heat generated in the aperture unit.

The first heat dissipation member and the second heat dissipation member may be combined by mating one to the other, while a seal member may be arranged between the first heat dissipation member and the second heat dissipation member in a mating surface thereof. This structure can more securely prevent the coolant from leaking out of the coolant flow path, thereby more stably removing the heat generated in the aperture unit.

The open X-ray source in accordance with one aspect of the present invention is an open X-ray source comprising an electron source for emitting an electron beam, a target for generating an X-ray in response to the electron beam incident thereon, and an electron path, extending from the electron source to the target, for passing the electron beam therethrough, the open X-ray source being adapted to open and close the electron path with respect to an external atmosphere and vacuum the electron path when closed, the open X-ray source further comprising the above-mentioned cooling structure used for the open X-ray source.

This open X-ray source comprises the above-mentioned cooling structure used for the open X-ray source and thus can effectively remove the heat generated in the aperture unit, thereby securely suppressing the X-ray focal spot drift caused by thermal expansions of constituent members due to the heating of the aperture unit in the open X-ray source.

Advantageous Effects of Invention

The present invention can effectively remove the heat generated in the aperture unit and securely suppress the X-ray focal spot drift caused by thermal expansions of constituent members due to the heating of the aperture unit in the open X-ray source.

DESCRIPTION OF EMBODIMENTS

Figure 1:
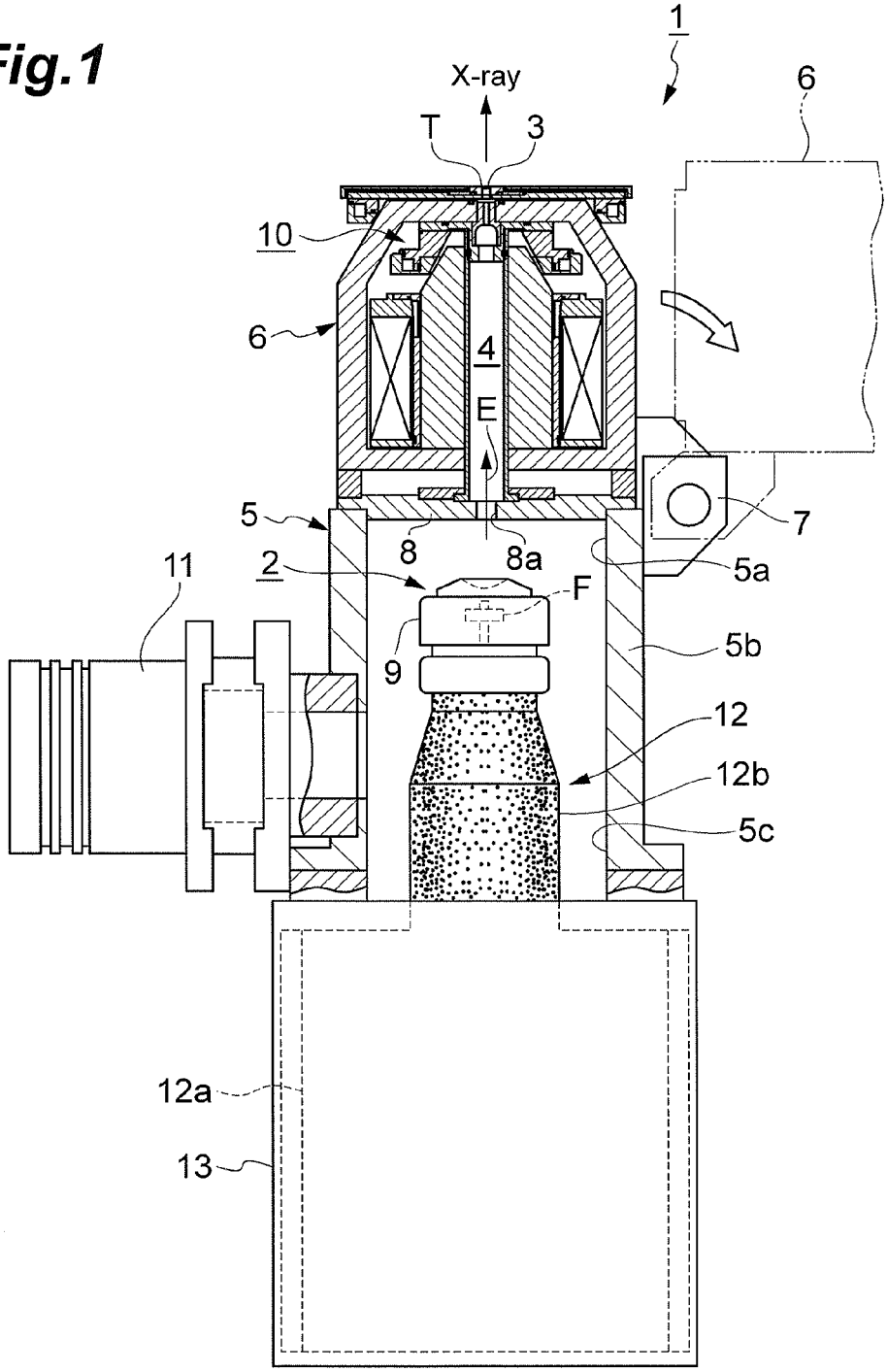
FIG. 1 is a vertical sectional view of the X-ray generator in accordance with an embodiment of the present invention.

In the following, preferred embodiments of the present invention will be explained in detail with reference to the drawings. In the drawings, the same or equivalent parts will be referred to with the same signs, while omitting their overlapping descriptions.

As illustrated in FIG. 1, an X-ray generator (open X-ray source) 1 comprises an electron gun (electron source) 2 for emitting an electron beam E, a target 3 for generating an X-ray in response to the electron beam E incident thereon, and an electron path 4, extending from the electron gun 2 to the target 3, for passing the electron beam E therethrough. The electron gun 2 is contained in a cylindrical lower barrel 5 made of stainless steel. The target 3 is formed in a target unit T. The target unit. T is detachably attached to an upper end part of a double cylindrical upper barrel 6. The electronic path 4 is provided within the barrels 5, 6 so as to extend from the electron gun 2 to the target 3.

The upper barrel 6 is vertically disposed on the lower barrel 5 through a hinge 7. In this state, an upper end opening 5*a* of the lower barrel 5 is closed with a lower wall 8 of the upper barrel 6. In the X-ray generator 1, the upper barrel 6 may be tilted with respect to the lower barrel 5 through the hinge 7 (see the dash-double-dot line in FIG. 1), so as to open the upper opening 5*a* of the lower barrel 5, thereby allowing a filament unit F arranged within a grid unit 9 of the electron gun 2 to be replaced.

A vacuum pump 11 for producing a high vacuum state in the electron path 4 is connected to the side wall 5*b* of the lower barrel 5. As a consequence, the electron path 4 can be vacuumed in a state closed to external atmospheres after replacing the target unit T and filament unit F, though it is opened to the external atmospheres when replacing the target unit T and filament unit F.

A mold power supply unit 12 integrated with the electron gun 2 is airtightly secured to a lower opening 5*c* of the lower barrel 5. The mold power supply unit 12 is one in which a high voltage generator and the like are molded with an electrically insulating resin and has a rectangular parallelepiped main unit 12*a* located under the lower barrel 5 and a cylindrical neck 12*b* projecting from the main unit 12*a* into the lower barrel 5. The main unit 12*a* is contained in a case 13 made of a metal.

Figure 2:
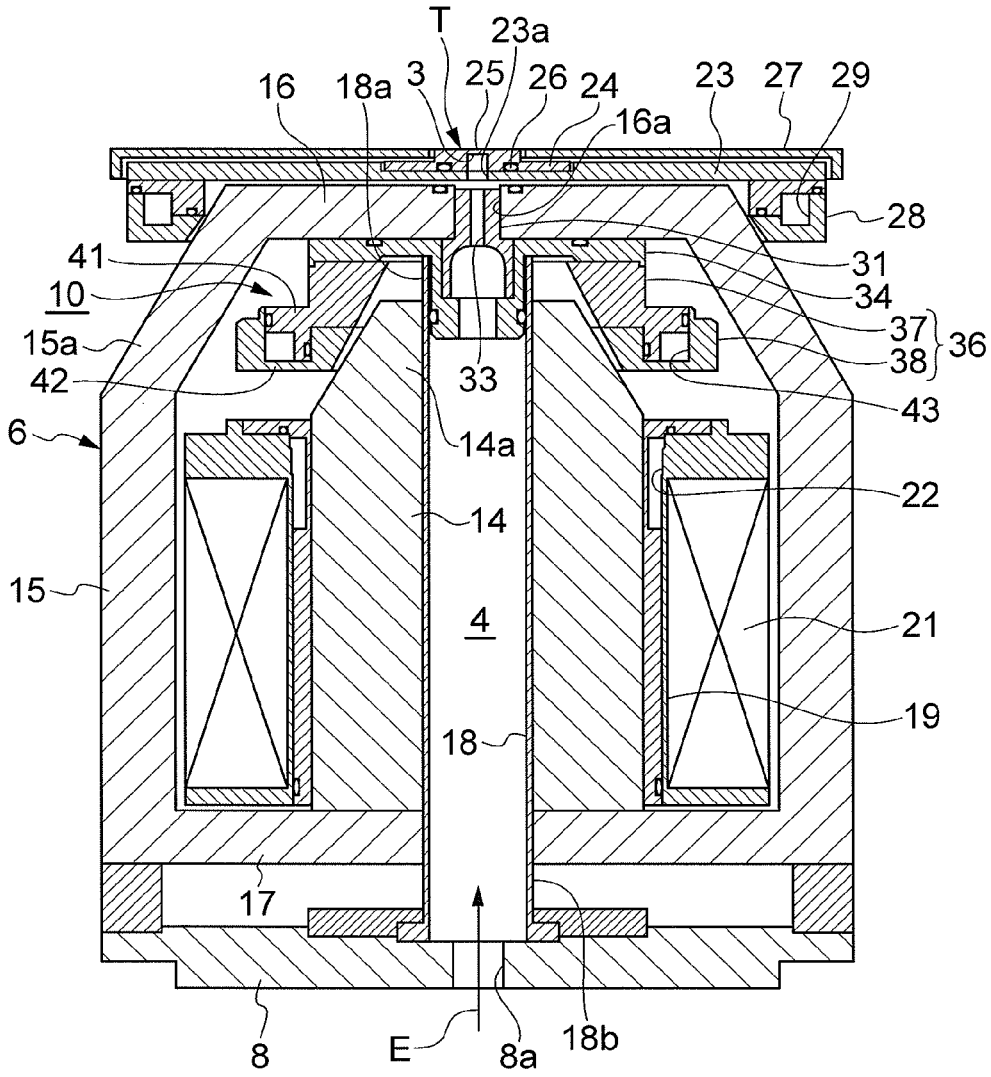
FIG. 2 is a vertical sectional view of an upper barrel in the X-ray generator of FIG. 1.

As illustrated in FIG. 2, the upper barrel 6 has cylindrical inner barrel 14 and cylindrical outer barrel 15. An upper end part 14*a* of the inner barrel 14 and an upper end part 15*a* of the outer barrel 15 taper their diameters toward the upper side like circular truncated cones. The outer barrel 15 is integrally formed with an upper wall 16 and a lower wall 17. The upper wall 16 opposes the upper end part 14*a* of the inner barrel 14 while being separated from the upper end part 14*a*. The lower wall 17 is in contact with the lower end of the inner barrel 14.

A pipe member 18 made of stainless steel is inserted in the inner barrel 14. An upper end part 18*a* of the pipe member 18 opposes the target 3 through a through hole 16*a* of the upper wall 16. A lower end part 18*b* of the pipe member 18 penetrates through the lower wall 17 and opposes the electron gun 2 through a through hole 8*a* of the lower wall 8. That is, the pipe member 18 constitutes a part of the electron path 4, extending from the electron gun 2 to the target 3, for passing the electron beam E therethrough.

An electromagnetic coil 21 formed by winding an enamel wire about a bobbin 19 is arranged between the inner barrel 14 and outer barrel 15. The electromagnetic coil 21 surrounds the electron path 4 and converges the electron beam E passing through the electron path 4 onto the target 3. The inner barrel 14, outer barrel 15, upper wall 16, and lower wall 17 are made of a magnetic material such as soft iron and constitutes a part of a magnetic circuit through which a magnetic flux generated by the electromagnetic coil 21 passes.

The bobbin 19 is provided with a coolant flow path 22 which surrounds the inner cylinder 14 in substantially the whole part where the inner barrel 14 and the bobbin 19 oppose each other. Specifically, the coolant flow path 22 is disposed in a wavy, saw-toothed, zigzag, or helical form, so as to increase the cooling area, thereby cooling the electromagnetic coil 21 as a whole. For example, water is caused to circulate through the coolant flow path 22 as a liquid coolant at the time when the X-ray generator 1 operates. As a consequence, even if the electromagnetic coil 21 generates heat upon energization at the time when the X-ray generator 1 operates, the heat generated in the electromagnetic coil 21 will propagate to water in the coolant flow path 22 through the bobbin 19. Therefore, the coolant flow path 22 can remove the heat generated in the electromagnetic coil 21 and suppress the X-ray focal spot drift caused by thermal expansions of constituent members due to the heating of the electromagnetic coil 21.

A holder 23 shaped like a circular sheet for holding the target unit T is airtightly secured onto the upper wall 16 of the upper barrel 6. The holder 23 has a through hole 23*a* located between the through hole 16*a* of the upper wall 16 and the target 3 of the target unit T. The target unit T has an annular support frame 24 made of stainless steel. An X-ray exit window 25 made of beryllium is secured to the support frame 24. The lower face of the X-ray exit window 25 is formed with the target 3 made of tungsten.

An O-ring 26 is arranged between the holder 23 and the support frame 24 of the target unit T. In this state, a cap-shaped press member 27 attached to the holder 23 presses the support frame 24 against the holder 23. This secures the airtightness between the target unit T and the holder 23. Removing the press member 27 allows the target unit T to be replaced in the X-ray generator 1.

An annular heat dissipator 28 surrounding the upper end part 15*a* of the outer barrel 15 is secured and connected to the lower face of the holder 23. The heat dissipator 28 is provided with an annular coolant flow path 29 surrounding the upper end part 15*a* of the outer barrel 15. For example, water is caused to circulate through the coolant flow path 29 as a liquid coolant at the time when the X-ray generator 1 operates. As a consequence, even if the target unit T generates heat in response to the electron beam E at the time when the X-ray generator 1 operates, the heat generated in the target unit T will propagate to water in the coolant flow path 29 through the holder 23 and heat dissipator 28. Therefore, the coolant flow path 29 can remove the heat generated in the target unit T and suppress the X-ray focal spot drift caused by thermal expansions of constituent members due to the heating of the target unit T.

Figure 3:
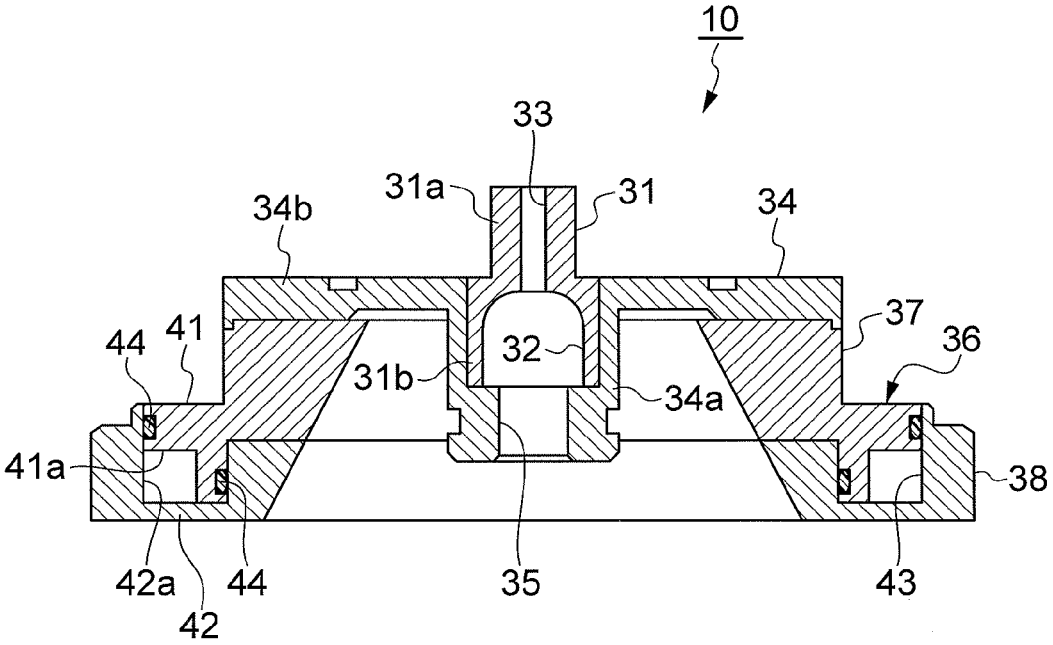
FIG. 3 is a vertical sectional view of an aperture cooling structure in the X-ray generator of FIG. 1.

As illustrated in FIGS. 2 and 3, the X-ray generator 1 uses an aperture cooling structure (cooling structure used for the open X-ray source) 10. The aperture cooling structure 10 is equipped with an aperture unit 31 shaped into a stepped cylinder arranged on the electron path 4. An upper part 31*a* of the aperture unit 31 is arranged within the through hole 16*a* of the upper wall 16. A lower part 31*b* of the aperture unit 31 has a diameter larger than that of the upper part 31*a* and is arranged under the upper wall 16. The lower end face of the lower part 31*b* is formed with a depression 32. The upper part 31*a* is formed with an aperture 33 extending from the bottom face of the depression 32 to the upper end face of the upper part 31*a*. The aperture 33 is a through hole having a diameter smaller than that of the depression 32 and restricts the electron beam E from passing therethrough.

The aperture unit 31 is held by a holder 34. The holder 34 opens to the upper side and includes a cylindrical main unit 34*a* having an inner face provided with a step and an annular flange 34*b* surrounding the electron path 4. The flange 34*b* is integrally formed with an upper end part of the main unit 34*a*. The main unit 34*a* has a bottom part formed with an electron passage hole 35 for transmitting the electron beam E therethrough. The lower part 31*b* of the aperture unit 31 is arranged within the main unit 34*a* so as to be mounted on the step. The lower part of the main unit 34*a* is arranged within the upper end part 18*a* of the pipe member 18. In this state, the flange 34*b* is airtightly secured to the lower face of the upper wall 16.

An annular heat dissipator 36 surrounding the upper end part 14*a* of the inner barrel 14 is secured and connected to the holder 34. The holder 34 is in surface contact with the heat dissipator 36 through the flange 34*b*. The heat dissipator 36 has heat dissipation member (first heat dissipation member) 37 located on the upper side and heat dissipation member (second heat dissipation member) 38 located on the lower side.

The heat dissipation member 37 includes an annular coolant flow path constituent part (first coolant flow path constituent part) 41 surrounding the electron path 4. The coolant flow path constituent part 41 has a rectangular cross section. The coolant flow path constituent part 41 is formed with an annular cutout 41*a* surrounding the electron path 4. The cutout 41*a* has a rectangular cross section which opens to the outer and lower sides.

The heat dissipation member 38 includes an annular coolant flow path constituent part (second coolant flow path constituent part) 42 surrounding the electron path 4. The coolant flow path constituent part 42 has a rectangular cross section. The coolant flow path constituent part 42 is formed with an annular groove 42*a* surrounding the electron path 4. The groove 42*a* has a rectangular cross section which opens to the upper side.

The coolant flow path constituent part 41 and coolant flow path constituent part 42 are combined with each other such as to construct a tubular structure when the coolant flow path constituent part 41 mates with the coolant flow path constituent part 42 (i.e., when the coolant flow path constituent part 41 mates with the groove 42*a*). As a consequence, the coolant flow path constituent part 41 and coolant flow path constituent part 42 construct an annular coolant flow path 43 surrounding the electron path 4. The coolant flow path 43 corresponds to a region where the cutout 41*a* and groove 42*a* overlap each other. For example, water is caused to circulate through the coolant flow path 43 as a liquid coolant at the time when the X-ray generator 1 operates.

In the outer side faces (mating surfaces) of the coolant flow path constituent part 41 and groove 42*a* in contact with each other, an O-ring (seal member) 44 is arranged between the coolant flow path constituent part 41 and coolant flow path constituent part 42. Similarly, in the inner side faces (mating surfaces) of the coolant flow path constituent part 41 and groove 42*a* in contact with each other, an O-ring (seal member) 44 is arranged between the coolant flow path constituent part 41 and coolant flow path constituent part 42.

Here, the aperture unit 31 is made of a material having a melting point higher than that of the holder 34, while the holder 34 is made of a material having a coefficient of thermal conductivity higher than that of the aperture unit 31. This condition is satisfied when the aperture unit 31 is made of molybdenum and holder 34 is made of copper or a copper alloy, for example. The heat dissipation member 37 and heat dissipation member 38 are made of the same material, an example of which is brass. When deionized water is caused to circulate through the coolant flow path 43 as a liquid coolant, copper or a copper alloy can be used as a material for the heat dissipation members 37, 38.

In thus constructed X-ray generator 1, the electron beam E is emitted upward from the filament unit F of the electron gun 2 in a state where the electron path 4 is vacuumed to a high degree of vacuum while being closed to external atmospheres. The emitted electron beam E is converged by the electromagnetic coil 21 and narrowed by the aperture 33 during when passing through the electron path 4, so as to be made incident on the target 3 of the target unit T. This allows the target 3 to emit the X-ray upward.

When the X-ray generator 1 operates, as mentioned above, the heat generated in the electromagnetic coil 21 is removed by the coolant flow path 22, while the heat generated in the target unit T is removed by the coolant flow path 29. These can suppress the X-ray focal spot drift caused by thermal expansions of constituent members due to the heating of the electromagnetic coil 21 and target unit T.

In addition, since the aperture cooling structure 10 is used, the heat generated in the aperture unit 31 propagates to water in the coolant flow path 43 through the holder 34 and heat dissipator 36. This can effectively remove the heat generated in the aperture unit 31, thereby securely suppressing the X-ray focal spot drift caused by thermal expansions of constituent members due to the heating of the aperture unit 31.

Thus removing the heat generated in the aperture unit 31 is effective in particular when the X-ray generator 1 is required to emit the X-ray at a microfocus. The reason is as follows.

For achieving a microfocus, not only converging the electron beam E but removing its scattered components is very important. Therefore, the aperture unit 31 arranged on the electron path 4 may remove as much as 80% to 90% of the electron beam E emitted from the electron gun 2, for example. That is, the amount of heat generated in the aperture unit becomes very large in order to achieve the microfocus.

In the X-ray generator 1, not only the heat generated in the electromagnetic coil 21 and target unit T is removed by the coolant flow paths 22, 29, but the heat generated in the aperture unit 31 is effectively cooled by the aperture cooling structure 10. Hence, the X-ray generator 1 can securely inhibit the X-ray from shifting the focal point due to thermal expansions of constituent members at the time when it operates and thereby deteriorating characteristics. Even when required to emit the X-ray at a microfocus, the X-ray generator 1 can securely suppress the X-ray focal spot drift and thus can favorably be used in X-ray CT systems. The coolant flow path 43 is directly formed in the heat dissipator 36 and thus exhibits a high heat dissipation effect. The coolant flow path 43, which forms a tubular structure by combining the coolant flow path constituent part 41 of the heat dissipation member 37 and the coolant flow path constituent part 42 of the heat dissipation member 38 with each other, has a high degree of freedom in designing concerning size, number, form, and the like and can be manufactured easily.

The aperture unit 31 is made of a material having a melting point higher than that of the holder 34, while the holder 34 is made of a material having a coefficient of thermal conductivity higher than that of the aperture unit 31. This can stably restrict the electron beam E from passing through the aperture unit 31. This also allows the heat generated in the aperture unit 31 to propagate efficiently from the aperture unit 31 to the holder 34.

The holder 34 has the flange 34*b* surrounding the electron path 4 and is in surface contact with the heat dissipator 36 through the flange 34*b*. This structure can increase the contact area between the holder 34 and heat dissipator 36, so as to allow the heat generated in the aperture unit 31 to propagate efficiently from the holder 34 to the heat dissipator 36.

The heat dissipation members 37, 38 provided with the coolant flow path 43 are made of the same material. This inhibits the coolant flow path constituent part 41 and coolant flow path constituent part 42 from generating a gap therebetween due to the difference between their coefficients of thermal conductivity. In addition, the coolant flow path constituent part 41 mates with the coolant flow path constituent part 42, while the O-rings 44 are arranged between the heat dissipation member 41 and heat dissipation member 42 in their mating surfaces. This can securely prevent water from leaking out of the coolant flow path 43, thereby stably removing the heat generated in the aperture unit 31.

Figure 4:
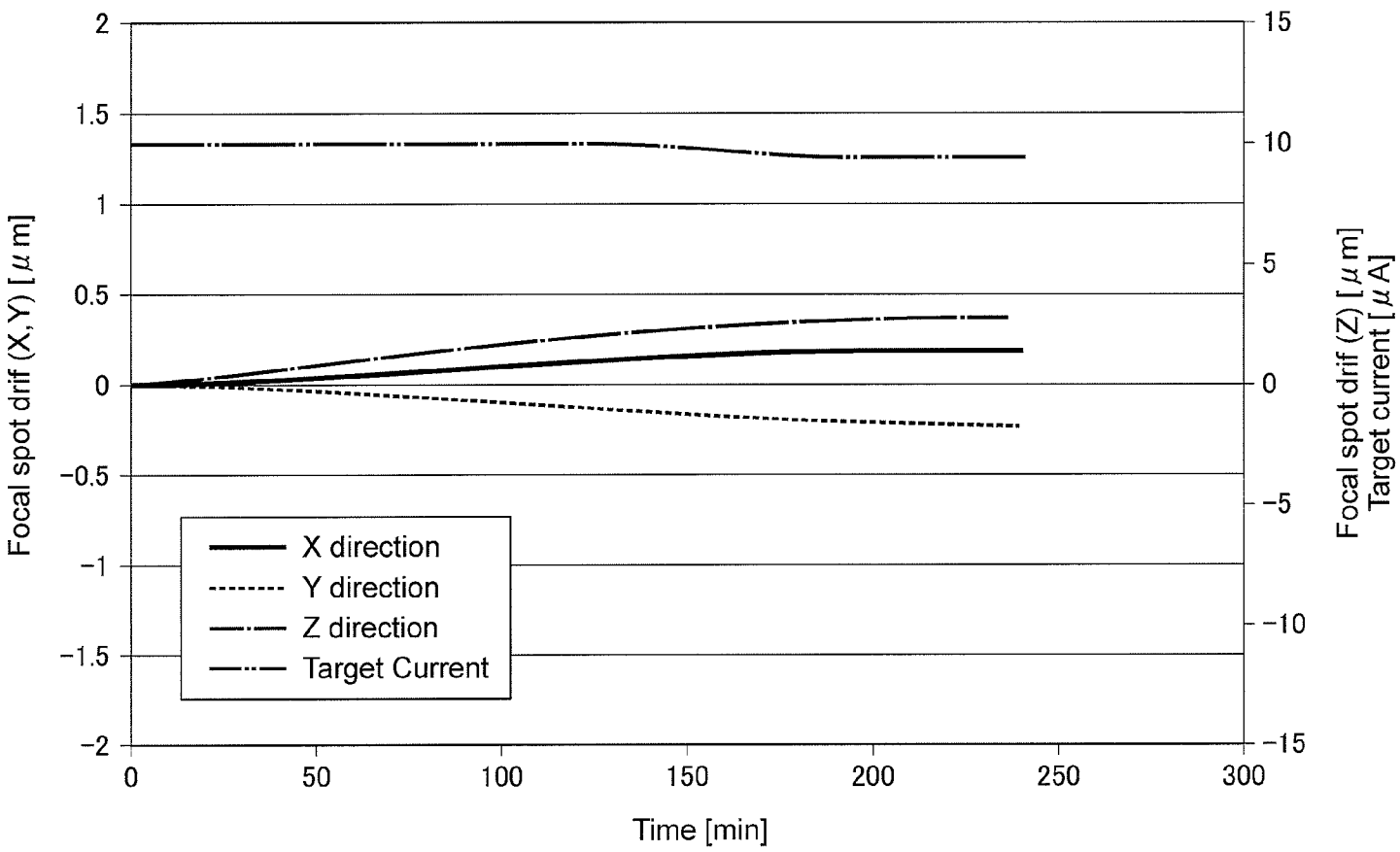
FIG. 4 is a graph illustrating changes in the X-ray focal spot drift with time in the X-ray generator of an example.

FIG. 4 is a graph illustrating changes in the X-ray focal spot drift with time in the X-ray generator of an example. The X-ray generator of the example has the same structure as with the above-mentioned X-ray generator 1. As illustrated in FIG. 4, the X-ray focal spot drift was suppressed to within +0.5 μm in the X direction and Y direction (respective directions of an orthogonal coordinate system set within a horizontal plane) and within −3 μm in the Z direction (vertical direction, i.e., optical axis direction) even after the lapse of 200 min from when the X-ray generator started to operate. The target current was also yielded steadily, from which it was seen that a fixed amount of X-ray was obtained stably.

Figure 5:
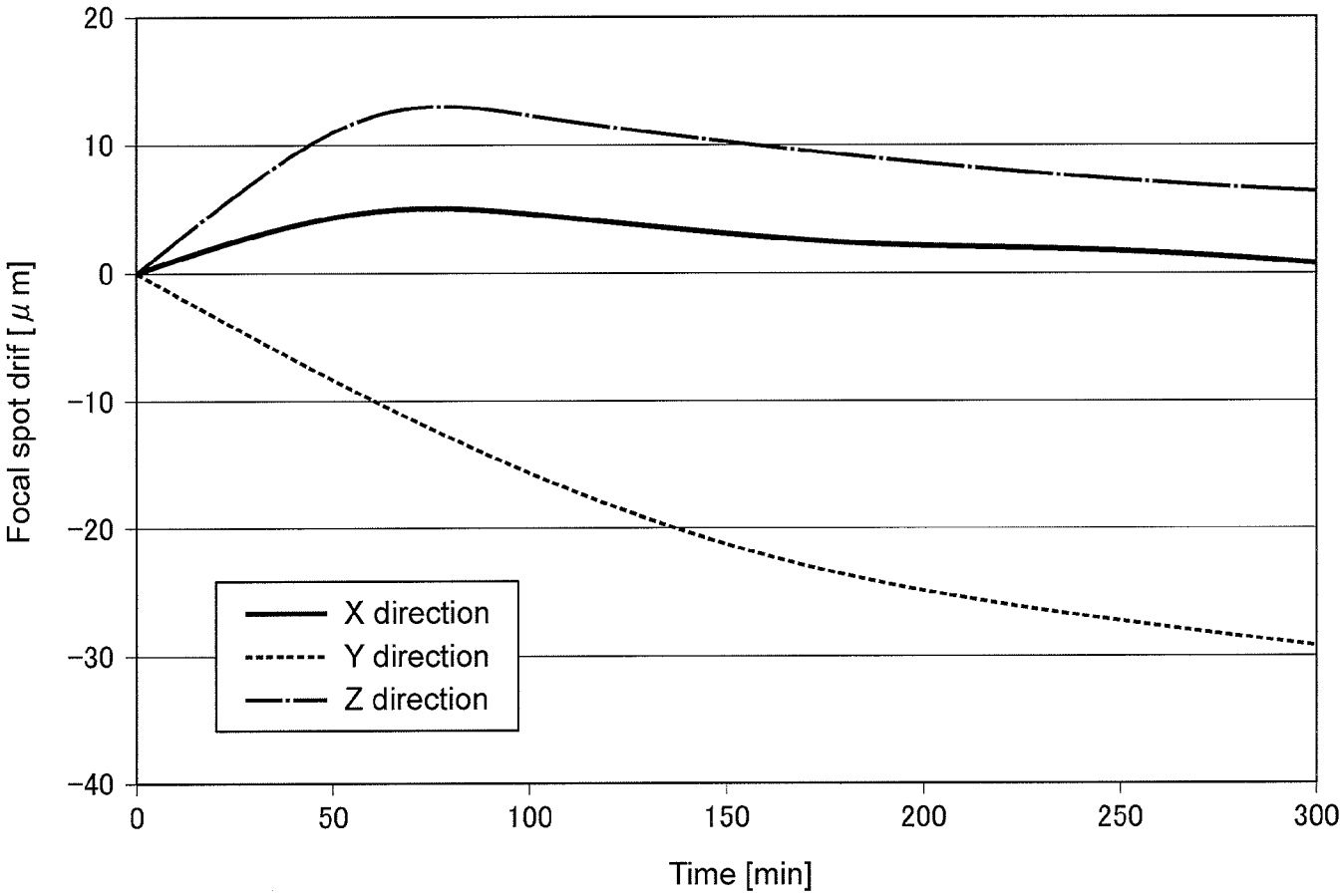
FIG. 5 is a graph illustrating changes in the X-ray focal spot drift with time in the X-ray generator of a comparative example.

On the other hand, FIG. 5 is a graph illustrating changes in the X-ray focal spot drift with time in the X-ray generator of a comparative example. The X-ray generator of the comparative example is one in which no water is caused to circulate through the coolant flow paths 22, 29, 43 in the above-mentioned X-ray generator 1. As illustrated in FIG. 5, the X-ray focal spot drift in the X-ray generator of the comparative example was more than +10 μm in the Z direction after the lapse of 50 min from when the X-ray generator started to operate and less than −20 μm in the Y direction after the lapse of 150 min from the starting of the X-ray generator.

Hence, the X-ray generator of the example can be considered to be able to inhibit the X-ray from shifting the focal point due to thermal expansions of constituent members at the time when it operates as compared with the X-ray generator of the comparative example.

The present invention is not limited to one embodiment thereof explained in the foregoing. For example, while the coolant flow path constituent part 41 mates with the groove 42*a* of the coolant flow path constituent part 42 in the above-mentioned embodiment, the coolant flow path constituent part 41 may be formed with a groove and so forth, so that the coolant flow path constituent part 42 mates with the groove of the coolant flow path constituent part 41.

Figure 6:
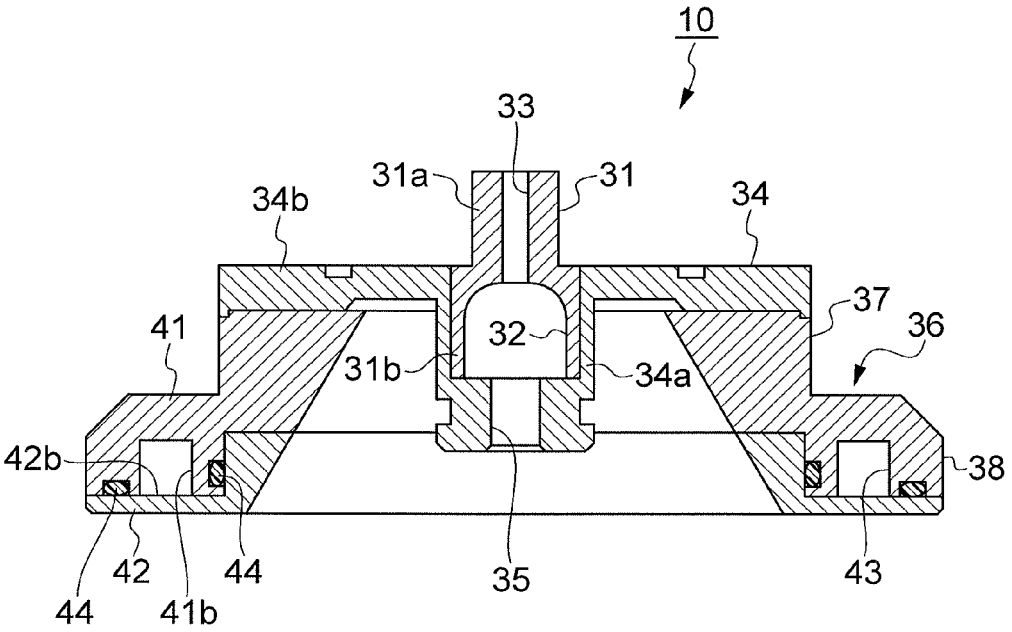
FIG. 6 is a vertical sectional view of a modified example of the aperture cooling structure in FIG. 3.

As illustrated in FIG. 6, the coolant flow path constituent part 41 may be formed with a groove 41*b* which opens to the lower side, while the coolant flow path constituent part 42 may be formed with a cutout 42*b* opening to the upper and outer sides, and the coolant flow path constituent part 41 may be arranged in the cutout 42*b*, so as to construct the coolant flow path 43. This can construct the coolant flow path 43 easily as compared with the above-mentioned embodiment.

Figure 7:
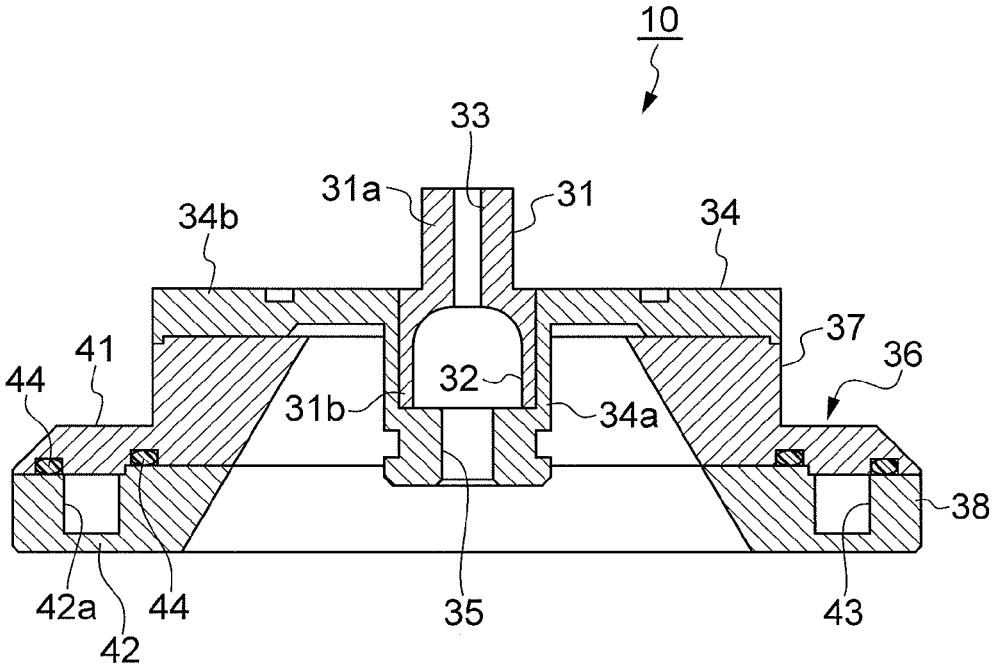
FIG. 7 is a vertical sectional view of a modified example of the aperture cooling structure in FIG. 3.

As illustrated in FIG. 7, the coolant flow path constituent part 41 may be free of cutouts and grooves, while the coolant flow path constituent part 42 may be formed with a groove 42*a* opening to the upper side, so that the coolant flow path constituent part 41 covers the groove 42*a*, thereby constructing the coolant flow path 43. This can construct the coolant flow path 43 more easily as compared with the above-mentioned embodiment.

Figure 8:
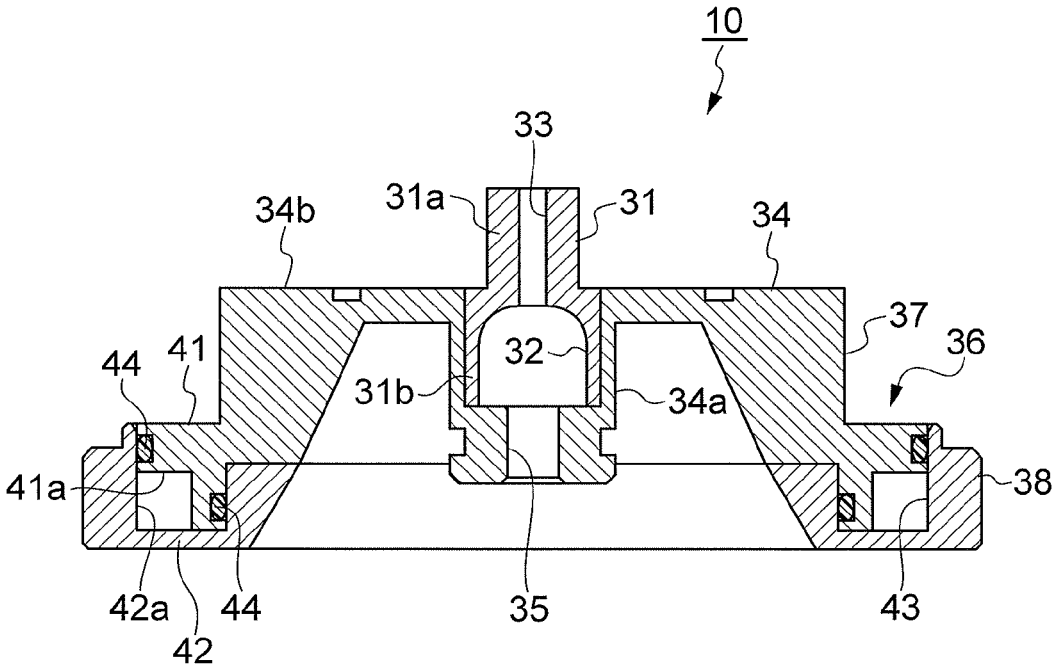
FIG. 8 is a vertical sectional view of a modified example of the aperture cooling structure in FIG. 3.

As illustrated in FIG. 8, the holder 34 and the heat dissipation member 37 of the heat dissipator 36 may be formed integrally with each other. In any of the cases explained in the foregoing, grooves for positioning the O-rings 44 arranged between the coolant flow path constituent part 41 and coolant flow path constituent part 42 may be formed on one of the coolant flow path constituent parts 41, 42 or both of them so as to oppose each other as long as they are located in surfaces where the flow path constituent parts 41, 42 are in contact with each other.

Coolants other than water may also be circulated through the coolant flow paths 22, 29, 43. The coolant flow path 43 may be formed into a plurality of annular rings such as double and triple ones, polygons, or a combination of a plurality of flow paths, so as to surround (hold therebetween) the electron path 4. Various materials and forms can be employed for constituent members of the X-ray generator 1 without being restricted to those mentioned above.

INDUSTRIAL APPLICABILITY

The present invention can effectively remove the heat generated in the aperture unit and securely suppress the X-ray focal spot drift caused by thermal expansions of constituent members due to the heating of the aperture unit in the open X-ray source.

REFERENCE SIGNS LIST

1 . . . X-ray generator (open X-ray source); 2 . . . electron gun (electron source); 3 . . . target; 4 . . . electron path; 10 . . . aperture cooling structure (cooling structure used for the open X-ray source); 31 . . . aperture unit; 33 . . . aperture; 34 . . . holder; 34*b* . . . flange; 36 . . . heat dissipator; 37 . . . heat dissipation member (first heat dissipation member); 38 . . . heat dissipation member (second heat dissipation member); 41 . . . coolant flow path constituent part (first coolant flow path constituent part); 42 . . . coolant flow path constituent part (second coolant flow path constituent part); 43 . . . coolant flow path; 44 . . . O-ring (seal member); E . . . electron beam

The invention claimed is:

1. A cooling structure used for an open X-ray source comprising an electron source for emitting an electron beam, a target for generating an X-ray in response to the electron beam incident thereon, and an electron path, extending from the electron source to the target, for passing the electron beam therethrough, the open X-ray source being adapted to open and close the electron path with respect to an external atmosphere and vacuum the electron path when closed, the cooling structure comprising:

an aperture unit arranged on the electron path and formed with an aperture for restricting the electron beam from passing therethrough;

a holder holding the aperture unit; and a heat dissipator connected to the holder, the heat dissipator being positioned so as to be spaced apart from the aperture via the holder so that the heat dissipator and the aperture do not directly contact each other;

wherein the heat dissipator has a first heat dissipation member including a first coolant flow path constituent part and a second heat dissipation member including a second coolant flow path constituent part; and wherein the first coolant flow path constituent part and the second coolant flow path constituent part are combined with each other so as to construct a coolant flow path, wherein the holder has a flange surrounding the electron path and is in surface contact with the heat dissipator through the flange.

2. The cooling structure used for the open X-ray source according to claim 1, wherein the aperture unit is made of a material having a melting point higher than that of the holder, while the holder is made of a material having a coefficient of thermal conductivity higher than that of the aperture unit.

3. The cooling structure used for the open X-ray source according to claim 1, wherein the first heat dissipation member and the second heat dissipation member are made of the same material.

4. The cooling structure used for the open X-ray source according to claim 1, wherein the first heat dissipation member and the second heat dissipation member are combined by mating one to the other, while a seal member is arranged between the first heat dissipation member and the second heat dissipation member in a mating surface thereof.

5. An open X-ray source comprising an electron source for emitting an electron beam, a target for generating an X-ray in response to the electron beam incident thereon, and an electron path, extending from the electron source to the target, for passing the electron beam therethrough, the open X-ray source being adapted to open and close the electron path with respect to an external atmosphere and vacuum the electron path when closed;

the open X-ray source further comprising the cooling structure used for the open X-ray source according to claim 1.

* * * * *